United States Patent [19]

Gilbert

[11] 4,209,900

[45] Jul. 1, 1980

[54] RETRACTABLE BLADE KNIFE

[75] Inventor: Richard Gilbert, Sheffield, England

[73] Assignee: Stanley Tools Limited, United Kingdom

[21] Appl. No.: 1,387

[22] Filed: Jan. 5, 1979

[30] Foreign Application Priority Data

Jan. 25, 1978 [GB] United Kingdom ..... 3088/78

[51] Int. Cl.[2] ..... B26B 1/08; B26B 5/00

[52] U.S. Cl. ..... 30/162

[58] Field of Search ..... 30/2, 162, 320

[56] References Cited

U.S. PATENT DOCUMENTS

| | | | |
|---|---|---|---|
| 3,765,089 | 10/1973 | Ibata | 30/162 X |
| 3,879,847 | 4/1975 | Roll | 30/162 |
| 3,888,002 | 6/1975 | Graham | 30/162 |
| 3,906,627 | 9/1975 | Manning | 30/162 |
| 4,005,525 | 2/1977 | Gringer | 30/162 |
| 4,139,939 | 2/1979 | Crooks | 30/162 |

*Primary Examiner*—Jimmy C. Peters

*Attorney, Agent, or Firm*—Prutzman, Kalb, Chilton & Alix

[57] ABSTRACT

A retractable blade knife adapted for use selectively with either the long narrow standard type of blade having score lines for breaking off successive end portions when worn and a large hole at its rear end or the shorter wider type of blade, sometimes double ended, with one or more smaller holes. The knife has a two part blade carrier. One part slides longitudinally relative to the other into two click positions. In each of these positions the upper part can pivot at its front end relative to the lower part. The rear end of the upper part is spring-biased away from the lower part to engage detent means on the upper part with detent means on the casing to locate the blade carrier. The front part has two bosses of different diameters, the small diameter boss projecting above the large diameter boss. All the blades lie in the same plane in the casing when in use respectively. The lower blade carrier part provides two pivotal support heights for the front end of the upper blade carrier part in the two click positions. The lower support height positions the smaller boss to engage the shorter, wider type of blade. The upper support height positions the larger boss to engage the long narrow type of blade.

6 Claims, 16 Drawing Figures

RETRACTABLE BLADE KNIFE

FIELD OF THE INVENTION

This invention relates to a retractable blade knife, and more particularly a retractable blade knife adapted for use for two different types of blade.

DISCUSSION OF THE PRIOR ART

There has come into widespread use a standard size of elongate blade scored at intervals along its length for the successive breaking off of used and worn end blade portions. This blade has a relatively large hole at its rear end for engagement by a projection of a sliding blade holder in a handle.

There has also come into widespread use a shorter, wider standard size of blade, not scored for breaking portions off, with one or more relatively smaller holes for engagement by a projection of a sliding blade holder in a handle. However, because the two standard sizes of blade came into existence from separate places entirely independently of each other, there is a common relationship neither between the widths of the two blades nor between the positions of the holes in relation to either the cutting edge or the opposite edge.

Accordingly, although one might imagine that there would be no difficulty in designing a knife able to take selectively either type of blade, it is in practice very difficult to design such a knife which satisfies commercial criteria of being reliable, cheap to produce, easy to use, not too big or bulky, giving accurate location and support to each type of blade, satisfactory detent location of the sliding holder along the handle and so forth.

SUMMARY OF THE INVENTION

As seen from one aspect of the invention there is provided a retractable blade knife comprising an elongated casing and a blade carrier which is longitudinally movable in the casing for advancing and retracting a blade, the blade carrier including a first part which is longitudinally slidably guided in a channel in the casing and which carries a second part, the second part having first detent means resiliently biased into engagement with second detent means on the casing for holding the blade carrier releasably in different positions along the casing, the blade carrier having a relatively large diameter boss for locating in a relatively large diameter hole in one type of blade, the blade carrier also having a relatively small diameter boss for locating in a relatively small diameter hole in another type of blade, the small diameter boss projecting from one end of the large diameter boss, the other end of the large diameter boss being mounted on said second part of the blade carrier, said second part being a rigid member which is pivotable relative to the first part about an axis in the region of the two bosses for engagement and disengagement of said first and second detent means, the blade carrier including means for setting the two bosses to either selected one of two alternative predetermined positions relative to said first part according to which type of blade is to be used.

Preferably the first part provides positive support for the bosses in at least the setting for the large diameter boss to be used with said one type of blade.

Preferably the first and second parts are relatively slidable between said two relative positions.

Preferably the first part includes resilience for biasing an edge opposite to a cutting edge of at least one of the blades against a blade-supporting part of the casing.

Preferably each type of blade when in use is in substantially the same plane relative to the casing and wherein movement of the bosses between said two alternative positions includes at least a component of movement normal to said plane.

Figure 1:
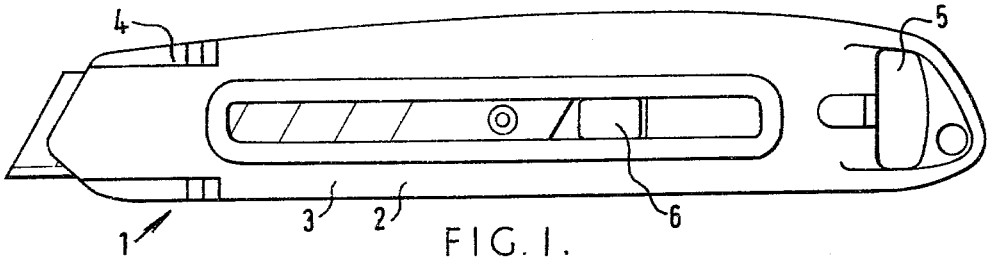
FIG. 1 is a side elevation of a retractable blade knife embodying the invention, shown with a first type of blade.
Figure 2:
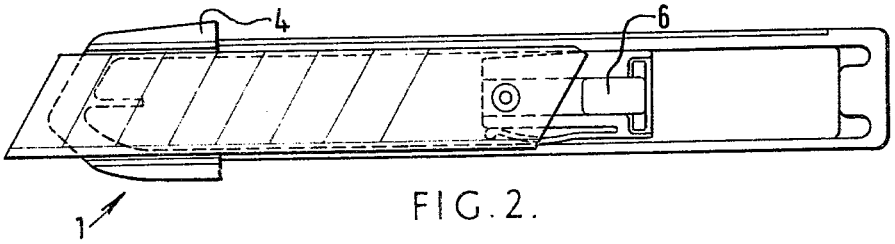
FIG. 2 is a similar view to FIG. 1, with part of the casing removed.

It will be appreciated that the drawings are drawn to a number of different scales.

DESCRIPTION OF THE PREFERRED EMBODIMENTS

Referring to the drawings, the illustrated retractable blade knife 1 comprises a casing 2 which forms an elongated handle and is in two parts 3 and 4, which are interconnected by a device 5, which is selectively operable to produce a relative sliding movement between the two parts 3 and 4 in a direction longitudinally of the handle, the two parts 3 and 4 interengaging with each other along at least one inclined "wedging" surface (not shown) such that the relative sliding movement of the two parts 3 and 4 causes them to be wedged together to clamp a blade firmly therebetween.

The knife 1 also comprises a blade carrier 6, which is longitudinally movable in the casing 2 for advancing and retracting a blade.

The blade carrier 6 includes a first part 7 which is longitudinally slidably guided in a channel 8 in the casing 2 and which carries a second part 9 of the blade carrier 6.

Figure 5:
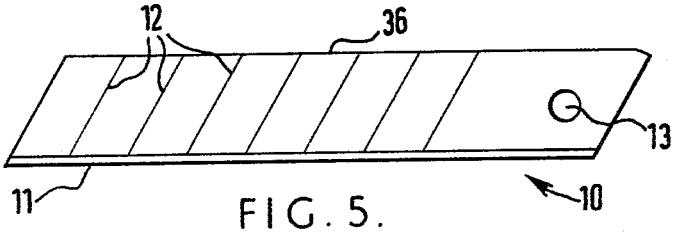
FIG. 5 illustrates the first type of blade.
Figure 6:
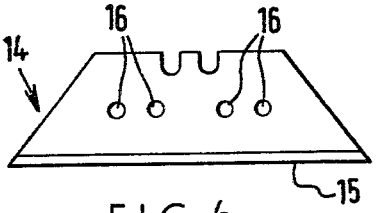
FIG. 6 illustrates the second type of blade.
Figure 7:
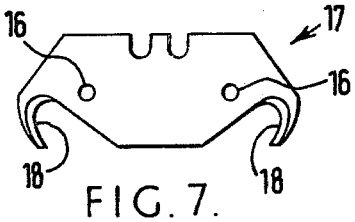
FIG. 7 illustrates a modified second type of blade.
Figure 8:
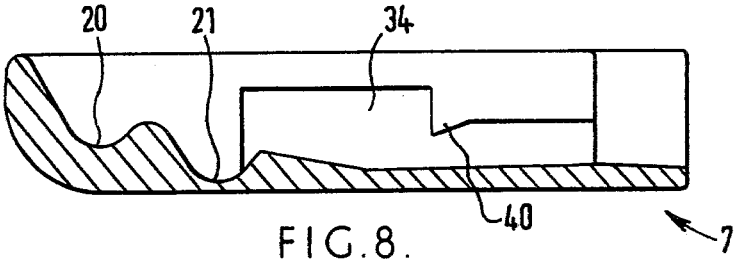
FIG. 8 is a longitudinal section through a first part of the blade carrier of the knife.
Figure 9:
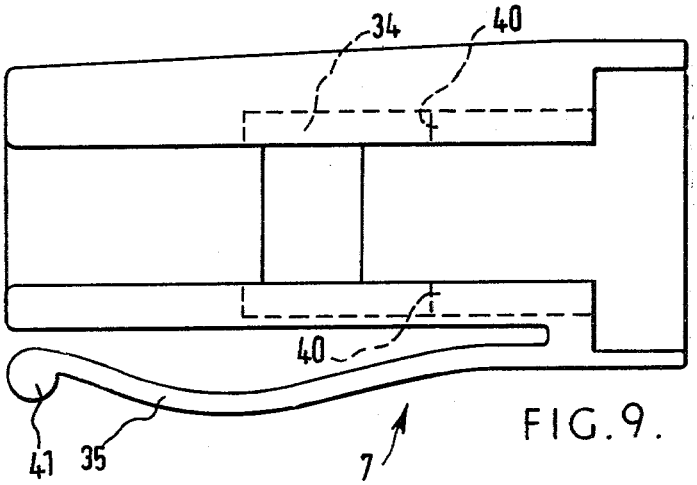
FIG. 9 is a side elevation of the first part of the blade carrier.
Figure 10:
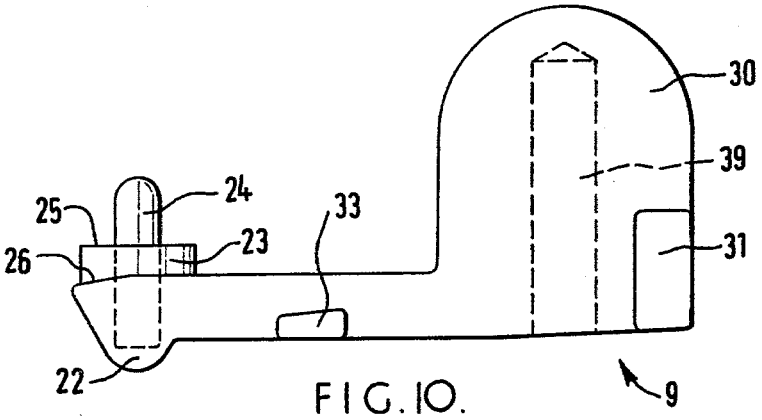
FIG. 10 is a side elevation of a second part of the blade carrier.
Figure 11:
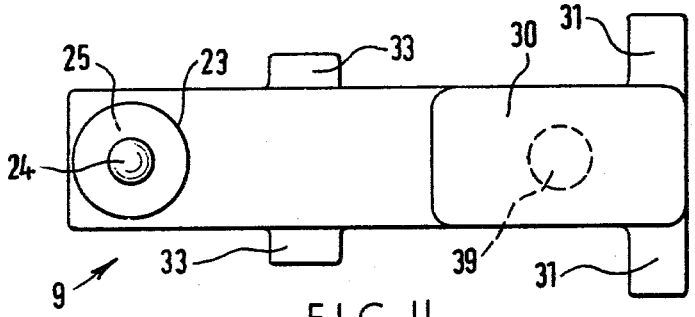
FIG. 11 is another side elevation of the second part of the blade carrier, from a different direction.
Figure 12:
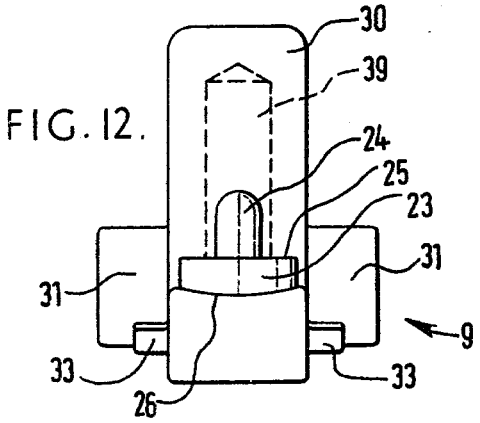
FIG. 12 is an end-view of the second part of the blade carrier.

Referring in particular to FIGS. 5, 6 and 7, FIG. 5 shows a first type of blade 10 which is relatively long, with a cutting edge 11 along one of its longer sides. The blade 10 is also provided with score lines 12 for breaking off successive portions of the blade 10 in a manner well known. The rear end of the blade 10 is provided with a relatively large diameter hole 13 for the purpose of connecting the blade 10 to the blade carrier 6 for advancing and retracting the blade 10.

The second type of blade 14, shown in FIG. 6, is shorter but wider (in the plane of FIGS. 5 and 6) than the blade 10.

The blade 14 has a cutting edge 15 along its longest side and has four relatively small diameter holes 16 for the purpose of connecting the blade 14 to the blade carrier 6.

It is convenient at this point to mention the modified second type of blade 17, shown in FIG. 7, differing from the blade 14 of FIG. 6 only in having two hooked cutting edges 18 and in having two, instead of four, holes 16 for connecting the blade 17 to the blade carrier 6.

It should be mentioned that each of the blades 10, 14 and 17 of FIGS. 5, 6 and 7 respectively is a well-known type of blade. The blade 10 of FIG. 5 was originally designed for use in a different design of knife from the blades 14 and 17 of FIGS. 6 and 7. Hence, there is no particular relationship between the width (vertically in FIG. 5) of the blade 10 and the diameter and position of its hole 13 on the one hand, to the width of each of the blades 14 and 17 and the diameters and positions of the holes 16 of FIGS. 6 and 7 on the other hand.

Referring now to FIGS. 8 to 12, the first blade carrier part 7 has a base 19 which is provided with two depressions 20 and 21 for receiving a somewhat bulbous projection 22 of the second blade carrier part 9.

The blade carrier 6 includes two bosses 23 and 24, the boss 23 being a relatively large diameter boss for engaging in the hole 13 of blade 10 (FIG. 5) and the boss 24 being a relatively small diameter boss for engaging in one of the holes 16 in the blades 14 and 17 (FIGS. 6 and 7). The small diameter boss 24 is formed as a pin which is seated in an aperture (not necessarily concentric) in the large diameter boss 23, so that the boss 24 projects upwardly (as seen, for example, in FIGS. 10 and 12 to 16) from the upper end 25 of the large diameter boss 23, the bottom end 26 of which is mounted on, in the sense of being integral with, the second blade carrier part 9. A springloaded plunger device 27, comprising a plunger 28 and a compression spring 29, is housed in a button 30 which forms part of the second blade carrier part 9, to bias first detents 31, also forming part of the second blade carrier part 9, into engagement with second detents 32 forming part of the casing 2. Finally, the second blade carrier part 9 is formed with stops 33 which locate in a cut-out 34 in the first blade carrier part 7, to limit relative movement of the two blade carrier parts 7 and 9.

To use the knife 1, that is to say, to load it with a blade, the casing 2 is opened (as described in the above-mentioned co-pending Patent Application No.) and the blade carrier 6 is removed. The second blade carrier part 9 is then positioned, by moving it forward or backward as necessary relative to the first blade carrier part 7, so that the bulbous projection 22 is either seated in the first depression 20 or the second depression 21 in the first blade carrier part 7. The stops 33, engaging in the cut out 34, limit the relative movement of blade carrier parts 7 and 9 so that the projection 22 must occupy either one or the other of the depressions 20 and 21. As shown clearly in FIG. 8, the depression 20 is above the level of the depression 21.

Figure 13:
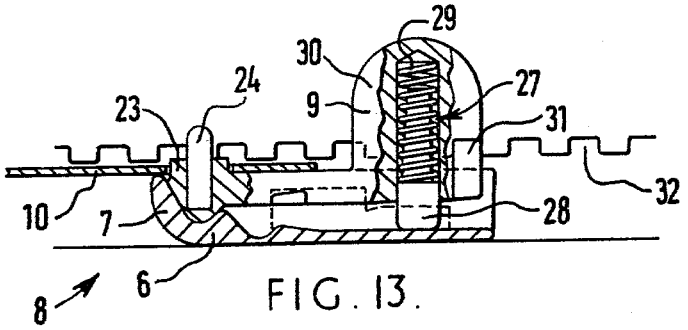
FIGS. 13 to 16 are four sectional partial views of the blade carrier and part of the casing, showing the positional relationship for each type of blade with the detent means engaged and disengaged respectively.
Figure 14:
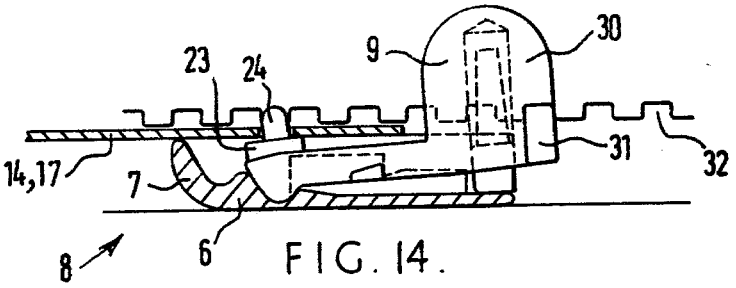
Figure 15:
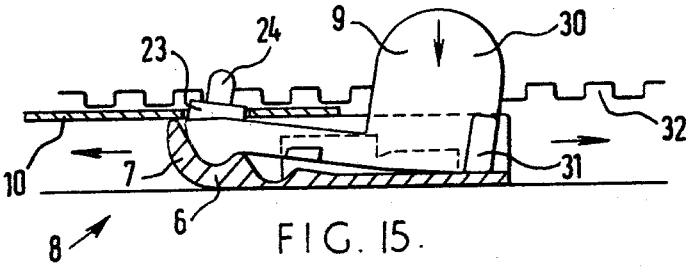
Figure 16:
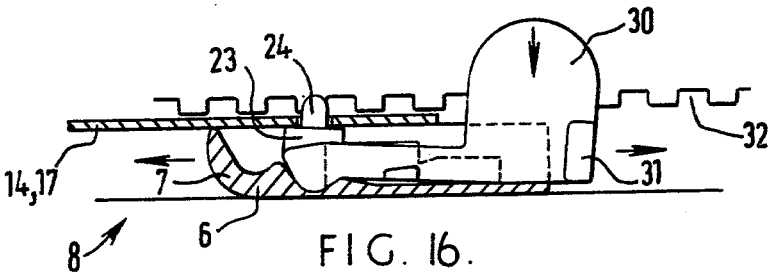

When the projection 22 is in the depression 20, the blade carrier parts 7 and 9 have the relative positions shown in FIGS. 13 and 15, so that the large diameter boss 23 is raised to such a level as to be engageable with the hole 13 in the first type of blade 10 of FIG. 5. When the blade carrier part 9 is removed rearwardly of the blade carrier part 7 to position the projection 22 in the second, lower, depression 21, as shown in FIGS. 14 and 16, the small diameter boss 24 is positioned to engage one of the holes 16 of the blade 14 of FIG. 6 or the blade 17 of FIG. 7, the large diameter boss 23 being in this case below the level of the blade. The plane of the blade (relative to the casing 2) is the same, whether it is the blade 10 or the blade 14 (or 17).

In either case, the button 30 can be depressed, as shown in FIGS. 15 and 16, to disengage the first detents 31 from the second detents 32, so that the blade carrier 6 can be advanced (to the left in FIGS. 15 and 16) or retracted (to the right in FIGS. 15 and 16) as desired, or advancing and retracting the blade 10, 14 or 17 respectively. When the button 30 is depressed, the second blade carrier part 9 pivots about an axis which is approximately concentric with the bulbous projection 22. Since this is in the vicinity of the bosses 23 and 24, it will be appreciated (from FIGS. 13 to 16) that depression and release of the button 30 does not interface unduly with the engagement of the large diameter boss 23 with blade 10 (FIGS. 13 and 15) or the engagement of the small diameter boss 24 with the blade 14 or 17 (FIGS. 14 and 16).

The blade carrier 6 provides acceptably rigid location of any of the blades 10, 14 and 17. This is partly due to the fact that the second blade carrier part 9 is a rigid member, with no relative movement between the first detent 31 and the bosses 23 and 24. It is also partly due to the positive support for the bosses 23 and 24, provided by the first blade carrier part 7, both when the projection 22 is seated in the recess 20, for using blade 10, and when the projection 22 is seated in the recess 21, for using blade 14 or 17.

The first blade carrier part 7 is formed with an integral cantilever spring 35 which engages the casing 2 and biases the blade 10, 14 or 17 relative to the casing in a direction away from the cutting edge 11, 15 or 18 respectively. This is important in the case of the blade 10 because of its being narrower than either of the blades 14 and 17, since it means that when the knife is used with the blade 10, the side 36 of the blade 10 opposite to the cutting edge 11 is already biased against the casing 2, so that when a cut is made with the blade 10, the blade is firmly supported and does not wobble.

Figure 3:
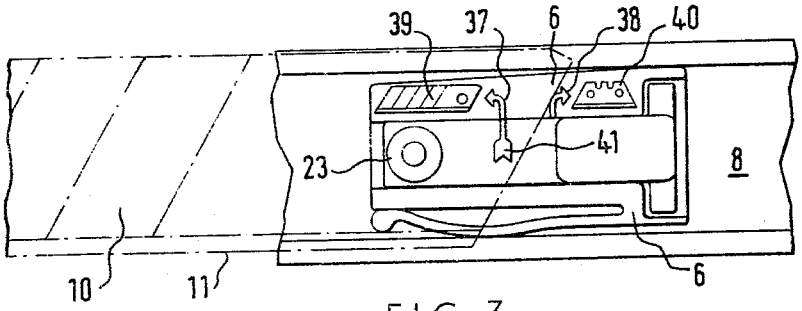
FIG. 3 is an enlargement of part of FIG. 2.
Figure 4:
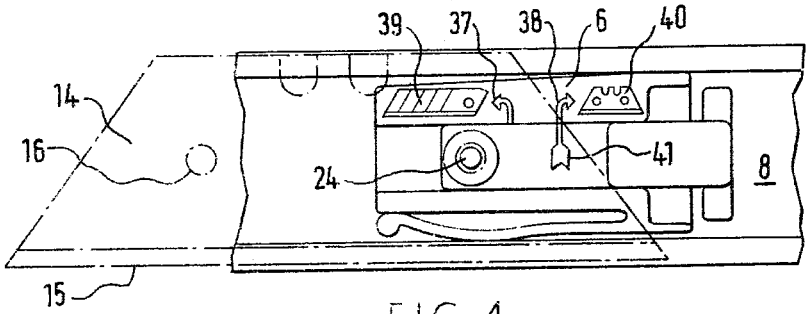
FIG. 4 corresponds to FIG. 3, but with a second type of blade.

Finally, indicia are provided on the blade carrier 6 to show how it should be used. These indicia include, on the first blade carrier part 7, two arrows, 37 and 38, pointing respectively to facsimiles 39 and 40 of the blade 10 and the blade 14 respectively. The second blade carrier part 9 has a single indicium 41, in the form of a tail of an arrow, which is aligned with the arrowhead 37 as shown in FIG. 3 when the blade carrier 6 is set to the position shown in FIGS. 13 and 15 for use with the blade 10. The indicium 41 is aligned with the arrowhead 38 as shown in FIG. 4, when the blade carrier 6 is set to the position shown in FIGS. 14 and 16 for use with the blade 14 (or the blade 17).

It should be mentioned that the spring 29 is located in a passage 39 in the button 30, and that the passage 39 has a small restriction (not shown) at its upper end for gripping the spring 29 firmly. In order to prevent the second blade carrier part 9 from becoming detached from the first blade carrier part 7 after assembly, the first blade carrier part 7 is formed with triangular projections 40 at the rear end of the cut out 34. These projections 40 permit the stop 33 to enter the cut out 34 when the blade carrier 6 is first assembled, and keep them there thereafter. The cantilever spring 35 is formed with an enlargement 41 at its free end for the purpose of reducing sideways play between the blade carrier 6 and the casing 2.

I claim:

1. A retractable blade knife comprising an elongated casing and a blade carrier which is longitudinally movable in the casing for advancing and retracting a blade, the casing having a channel therein, the blade carrier including first and second parts, the first part being longitudinally slidably guided in the channel in the casing and carrying the second part, the second part of the blade carrier including first detent means, the casing including second detent means, said first detent means being resiliently biased into engagement with said second detent means for holding the blade carrier releasably in different positions along the casing, the blade carrier including a relatively large diameter boss for locating in a relatively large diameter hole in one type of blade, the blade carrier also having a relatively small diameter boss for locating in a relatively small diameter hole in another type of blade, the small diameter boss projecting from one end of the large diameter boss, the other end of the large diameter boss being mounted on said second part of the blade carrier, said second part being a rigid member which is pivotable relative to the first part about an axis in the region of the two bosses for engagement and disengagement of said first and second detent means, the blade carrier including means for setting the two bosses to either selected one of two alternative predetermined positions relative to said first part according to which type of blade is to be used.

2. A retractable blade knife as claimed in claim 1 wherein the first part provides positive support for the bosses in at least the setting for the large diameter boss to be used with said one type of blade.

3. A retractable blade knife as claimed in claim 1 wherein the first and second parts are relatively slidable between said two relative positions.

4. A retractable blade knife as claimed in claim 1 wherein the first part includes resilience for biasing an edge opposite to a cutting edge of at least one of the blades against a blade-supporting part of the casing.

5. A retractable blade knife as claimed in claim 1 wherein each type of blade when in use is in substantially the same plane relative to the casing and wherein movement of the bosses between said two alternative positions includes at least a component of movement normal to said plane.

6. A retractable blade knife as claimed in claim 1 wherein the first part provides positive support for the bosses in at least the setting for the large diameter boss to be used with one type of blade; wherein the first and second parts are relatively slidable between said two relative positions; wherein the first part includes resilience for biasing an edge opposite to a cutting edge of at least one of the blades against a blade-supporting part of the casing; and wherein each type of blade when in use is in substantially the same plane relative to the casing and wherein movement of the bosses between said two alternative positions includes at least a component of movement normal to said plane.

* * * * *